US011457792B2

(12) United States Patent
Lee et al.

(10) Patent No.: US 11,457,792 B2
(45) Date of Patent: Oct. 4, 2022

(54) DISHWASHER

(71) Applicant: LG Electronics Inc., Seoul (KR)

(72) Inventors: Jongmin Lee, Seoul (KR); Byeonghyeon Ju, Seoul (KR); Daegyu Kim, Seoul (KR); Seyoung Woo, Seoul (KR); Taehee Lee, Seoul (KR); Joonho Pyo, Seoul (KR)

(73) Assignee: LG Electronics Inc., Seoul (KR)

( * ) Notice: Subject to any disclaimer, the term of this patent is extended or adjusted under 35 U.S.C. 154(b) by 417 days.

(21) Appl. No.: 16/460,478

(22) Filed: Jul. 2, 2019

(65) Prior Publication Data

US 2019/0320871 A1 Oct. 24, 2019

Related U.S. Application Data

(63) Continuation of application No. PCT/KR2017/015318, filed on Dec. 22, 2017.

(30) Foreign Application Priority Data

Jan. 2, 2017 (KR) ..... 10-2017-0000200

(51) Int. Cl.
*A47L 15/22* (2006.01)
*A47L 15/42* (2006.01)

(52) U.S. Cl.
CPC ..... *A47L 15/22* (2013.01); *A47L 15/4278* (2013.01); *A47L 15/4282* (2013.01); *A47L 15/4223* (2013.01)

(58) Field of Classification Search
CPC .. A47L 15/22; A47L 15/4223; A47L 15/4278; A47L 15/4282
See application file for complete search history.

(56) References Cited

U.S. PATENT DOCUMENTS 3,918,644 A * 11/1975 Platt ..... A47L 15/4282 239/243
2014/0083470 A1* 3/2014 Kim ..... A47L 15/428 134/183
2014/0216507 A1* 8/2014 Pyo ..... A47L 15/23 134/179

FOREIGN PATENT DOCUMENTS

EP 2601877 6/2013
EP 2954830 12/2015
(Continued)

OTHER PUBLICATIONS

PCT International Search Report and Written Opinion in International Application No. PCT/KR2017/015318, dated Apr. 6, 2018, 13 pages (with English translation).
(Continued)

*Primary Examiner* — Joseph L. Perrin
*Assistant Examiner* — Kevin G Lee
(74) *Attorney, Agent, or Firm* — Fish & Richardson P.C.

(57) ABSTRACT

A dishwasher includes a tub, a spray arm, and a spray arm. The spray arm includes an arm body that defines a plurality of channels that are partitioned from each other and that are configured to carry washing water and a plurality of spray holes configured to discharge washing water from the plurality of channels toward the washing objects. The spray arm further includes a chamber disposed vertically below the arm body and configured to communicate with the plurality of channels; a channel guider configured to supply washing water from the spray arm holder to the chamber; and a channel switch unit accommodated in the chamber and configured to open and close at least a portion of the plurality of channels.

20 Claims, 13 Drawing Sheets

(56) References Cited

FOREIGN PATENT DOCUMENTS

| | | |
|---|---|---|
| KR | 1020100109304 | 10/2010 |
| KR | 1020110120901 | 11/2011 |
| KR | 1020120126596 | 11/2012 |
| KR | 1020140039745 | 4/2014 |
| KR | 1020160009403 | 1/2016 |

OTHER PUBLICATIONS

Extended European Search Report in European U.S. Appl. No. 17/885,815., dated Nov. 4, 2020, 11 pages.

* cited by examiner

DISHWASHER

CROSS-REFERENCE TO RELATED APPLICATIONS

This application is a continuation of International Application No. PCT/KR2017/015318, filed on Dec. 22, 2017, which claims the benefit of Korean Application No. 10-2017-0000200, filed on Jan. 2, 2017. The disclosures of the prior applications are incorporated by reference in their entirety.

TECHNICAL FIELD

The present disclosure relates to a dishwasher, and more particularly, to a dishwasher that includes a washing water spray arm that can be rotated in both directions.

BACKGROUND

A dishwasher is an apparatus that can remove garbage such as food waste in dishes or cooking utensils (hereinafter, referred to as "washing objects") using a detergent and washing water.

In some cases, the dishwasher may include a washing tub for forming a washing space, a storage unit for accommodating washing objects in the washing tub, a spray arm for spraying washing water to the storage unit, and a sump for storing washing water and supplying the washing water into the spray arm.

In some cases, the dishwasher may remove garbage by spraying washing water to washing objects of the storage unit in accordance with a washing course selected by a user, and may dry washing objects where garbage has already been removed, by supplying the hot air.

SUMMARY

The present disclosure may provide a dishwasher with an improved washing power.

The present disclosure may also provide a dishwasher provided with a plurality of washing water channels on a spray arm.

The present disclosure may also provide a dishwasher where the spray arm is rotated in both directions by selectively opening and closing the plurality of washing water channels.

The present disclosure may also provide a dishwasher that may avoid washing water from being non-uniformly supplied to the spray arm due to overflow of the washing water when the washing water enters the inside of the spray arm.

The present disclosure may also provide a dishwasher that may completely descend a channel switch unit that selectively opens and closes washing water channels.

According to one aspect of the subject matter described in this application, a dishwasher includes a washing tub configured to receive washing objects, a spray arm rotatably disposed in the washing tub and configured to spray washing water toward the washing objects, and a spray arm holder that defines a supply channel configured to supply washing water to the spray arm. The spray arm includes an arm body that defines a plurality of channels that are partitioned from each other and that are configured to carry washing water, and a plurality of spray holes configured to discharge washing water from the plurality of channels toward the washing objects. The spray arm further includes a chamber disposed vertically below the arm body and configured to communicate with the plurality of channels, a channel guider configured to supply washing water from the spray arm holder to the chamber, and a channel switch unit accommodated in the chamber and configured to open and close at least a portion of the plurality of channels.

Implementations according to this aspect may include one or more of the following features. For examples, the channel guider may pass through the arm body and the chamber to couple to the spray arm holder, and may be configured to rotatably support the arm body and the chamber. In some examples, the channel guider may include a guider body disposed vertically below the chamber and configured to support the chamber and the arm body, an extension unit that extends upwardly from the guider body and passes through the chamber, the extension unit defining a plurality of exhaust holes configured to supply washing water into the chamber, and a coupling unit that is disposed at a top portion of the extension unit, that passes through the arm body to couple to the spray arm holder, and that is configured to receive washing water from the spray arm holder.

In some implementations, the guider body may include a bump that protrudes from a top surface of the guider body and that is configured to distribute washing water entering the extension unit toward the chamber. In some implementations, the coupling unit may include coupling bumps that protrude from an outer circumferential surface of the coupling unit and that are configured to couple to the spray arm holder.

In some implementations, the channel switch unit may be configured to move upward and downward along a longitudinal direction of the channel guider and to rotate within a predetermined angle about the channel guider based on moving upward and downward along the longitudinal direction. In some examples, the channel switch unit may include a switch body configured to move upward and downward along an outer circumferential surface of the channel guider, a plurality of radial protrusions that protrude from the switch body in a radius direction of the switch body and that are configured to cause the switch body to move upward based on buoyancy of washing water entering the chamber, and a plurality of channel openings, each channel opening being defined between the radial protrusions.

In some examples, the arm body may define a plurality of chamber communication holes that is configured to communicate with the plurality of channels and the chamber, and the radial protrusions may be configured to, based on the channel switch unit moving upward, be inserted into a part of the chamber communication holes and block the part of the chamber communication holes to thereby restrict supply of washing water to the plurality of channels. In some examples, the radial protrusions may define an outflow groove recessed from an outside of the radial protrusions in the radius direction. In some examples, the outflow groove may be configured to, in a state in which the radial protrusions are inserted into the chamber communication holes, allow a portion of washing water in the chamber to enter the corresponding channel to thereby increase a descending speed of the channel switch unit.

In some implementations, the arm body may further include a hollow tube that extends downwardly from the arm body and that receives the channel guider, and the switch body may further include a plurality of support bumps that protrude from an inner circumferential surface of the switch body toward an outer circumferential surface of the hollow tube. In some examples, the switch body may further include a plurality of spacers that protrude from a bottom surface of the switch body toward the chamber and that define a space between the bottom surface of the switch body and the chamber.

In some examples, the arm body may include a plurality of upper contact parts, each of the upper contact parts being disposed between the chamber communication holes, and the chamber may include a plurality of lower contact parts that protrude upwardly from a bottom surface of the chamber. The channel switch unit may include upper bumps that protrude upwardly from the radial protrusions and from the channel openings and that are configured to cause the switch body to rotate based on the upper bumps contacting the upper contact parts, and lower bumps configured to cause the switch body to rotate based on the lower bumps contacting the lower contact parts. In some examples, a width of the upper bumps that protrude upwardly from the channel openings decreases along a rotating direction of the switch body.

In some implementations, the radial protrusions may include a settling portion arranged between the upper bumps, and the upper bumps may include a first contact portion configured to start to contact the upper contact parts based on the switch body moving upward, and a second contact portion configured to contact the upper contact parts based on the switch body ceasing rotation. In some examples, the upper bumps may include a first inclined surface in which a height of the first inclined surface with respect to a top surface of the settling portion increases in a direction toward the first contact portion along a rotating direction of the switch body. The upper bumps may further include a second inclined surface in which a height of the second inclined surface with respect to the top surface of the settling portion decreases in a direction from the first contact portion toward the second contact portion.

In some implementations, a gradient of the second inclined surface may be less than a gradient of the first inclined surface.

In some examples, the lower bumps may include a third contact portion configured to start to contact the lower contact parts based on the switch body moving downward, and a fourth contact portion configured to contact the lower contact parts based on the switch body ceasing rotation.

In some implementations, the lower bumps may include a third inclined surface, wherein a height of the third inclined surface with respect to a bottom surface of the settling portion increases in a direction toward the third contact portion along a rotating direction of the switch body, and a fourth inclined surface, wherein a height of the fourth inclined surface with respect to the bottom surface of the settling portion decreases in a direction from the third contact portion toward the fourth contact portion.

In some implementations, the plurality of channels include a first channel configured to supply washing water to a first spray hole among the plurality of spray holes and configured to rotate the arm body in a first direction, and a second channel configured to supply washing water to a second spray hole among the plurality of spray holes and configured to rotate the arm body in a second direction. In these implantations, the arm body may define a first chamber communication hole that is configured to communicate with the first channel and the chamber, and a second chamber communication hole that is configured to communicate with the second channel and the chamber, and the channel switch unit may be configured to alternately open the first chamber communication hole and the second chamber communication hole.

In some implementations, the dishwasher may rotate a spray arm in both directions by selectively opening and closing a plurality of channels formed inside a spray arm. Therefore, a washing power of the dishwasher may be improved.

In some implementations, the dishwasher may uniformly supply washing water to each channel of the spray arm by uniformly distributing the washing water inside the spray arm.

In some implementations, the dishwasher may increase a descending speed of a channel switch unit by continuously supplying a part of washing water to a closed channel. Therefore, the spray arm may repeat forward rotation and reverse rotation smoothly.

DETAILED DESCRIPTION

Hereinafter, one or more implementations of the present disclosure will be described in more detail with reference to the accompanying drawings. Specific structural or functional descriptions in the implementations disclosed in this specification are intended to describe one or more examples of the present disclosure, and are not intended to limit the implementations according to the present disclosure to a specific disclosed type. It is to be understood that the implementations according to the present specification include all changes, equivalents, or replacements included in spirits and technical scope of the present disclosure. In addition, the same reference numbers will be used throughout the drawings to refer to the same or like parts and their description will be replaced with the first description.

Figure 1:
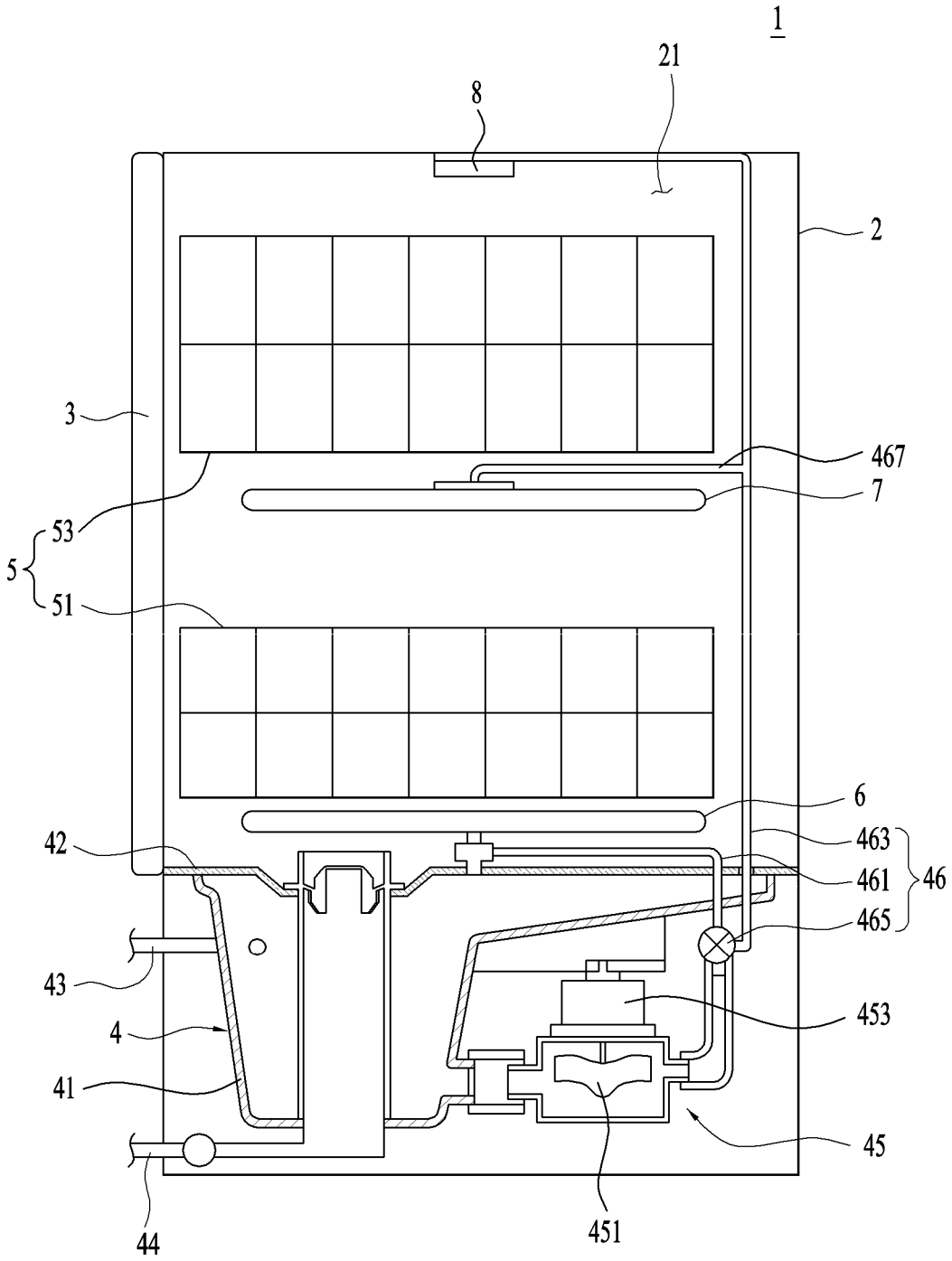
FIG. 1 is a cross-sectional view illustrating an example dishwasher.

FIG. 1 is a cross-sectional view illustrating an example dishwasher.

Referring to FIG. 1, the dishwasher 1 includes a housing forming an external appearance, a washing tub 2 forming a washing space 21 inside the housing, a door 3 selectively opening and closing the washing space 21, a sump 4 provided in a lower portion of the washing tub 2, storing washing water, a storage unit 5 provided inside the washing tub 2, accommodating washing objects, and spray arms 6, 7 and 8 spraying washing water toward the washing objects accommodated in the storage unit 5.

The washing tub 2 forms the washing space 21 in which washing objects are accommodated, and the storage unit 5 and spray arms 6, 7 and 8 may be provided in the washing space 21. The washing tub 2 has one surface that is opened, wherein the opened surface may be opened and closed by the door 3.

The door 3 may selectively open and close the washing space 21 by being rotatably connected to the housing. For example, the lower portion of the door 3 may be coupled to the housing by a hinge. In this case, the door 3 may be rotated around the hinge to open and close the washing tub 2. When the door 3 is opened, the storage unit 5 may be ejected to the outside of the dishwasher 1, and the storage unit 5 ejected to the outside may be supported by the door 3.

The sump 4 may include a storage unit 41 for storing washing water, a sump cover 42 for partitioning the storage unit 41 from the washing tub 2, a water supply unit 43 for supplying water from the outside to the storage unit 41, a drainage unit 44 for draining water of the storage unit 41 to the outside, and a water supply pump 45 and a supply channel 46 for supplying water in the storage unit 41 to the spray arms 6, 7 and 8.

The sump cover 42 may be provided on a top portion of the sump 4 to partition the washing tub 2 from the sump 4. In addition, the sump cover 42 may be provided with a plurality of water collecting holes to collect the water sprayed to the washing space 21 through the spray arms 6, 7, and 8. That is, the washing water sprayed from the spray arms 6, 7 and 8 may be dropped to a lower portion of the washing space 21 and may be again collected to the storage unit 41 of the sump 4 through the sump cover 42.

A water supply pump 45 may be provided on a side portion or a lower portion of the storage unit 41 and supply the washing water to the spray arms 6, 7 and 8.

One end of the water supply pump 45 may be connected to the storage unit 41 and the other end of the water supply pump 45 may be connected to the supply channel 46. An impeller 451 and a motor 453 may be provided inside the water supply pump 45. When a voltage is supplied to the motor 453 and water in the storage unit 41 may be supplied to the spray arms 6, 7 and 8 through the supply channel 46.

The supply channel 46 may selectively supply the washing water supplied from the water supply pump 45 to the spray arms 6, 7 and 8.

The supply channel 46 may include a first supply channel 461 connected to the lower spray arm 6, a second supply channel 463 connected to the upper spray arm 7 and a top nozzle 8, and a supply channel switch valve 465 selectively opening and closing the supply channels 461 and 463. In this case, the supply channel switch valve 465 may control the respective supply channels 461 and 463 to be sequentially opened or simultaneously opened.

At least one storage unit 5 may be provided in the washing space 21 to accommodate washing objects. The dishwasher 1 provided with two storage units is shown in FIG. 1 but is not limited to this case. For example, the dishwasher 1 may include one storage unit or three storage units or more. In this case, the number of spray arms may be different depending on the number of the storage units. Hereinafter, only the case that the dishwasher 1 includes two storage units will be described for convenience of description.

The storage unit 5 may include a lower rack 51 and an upper rack 52 to accommodate washing objects. The lower rack 51 may be arranged on the top portion of the sump 4, and the upper rack 53 may be arranged to be higher than the lower rack 51. The lower rack 51 and the upper rack 53 may be drawn outside through one exposed surface of the washing tub 2. To this end, a rail may be provided on an inner peripheral surface of the washing tub 2 and a wheel may be disposed below the racks 51 and 52. A user may store washing objects or take out already washed washing objects by drawing the storage unit 5 outside.

The spray arm may be provided inside the washing tub 2 to spray washing water toward washing objects of the storage unit 5.

The spray arm may include a lower spray arm 6, an upper spray arm 7, and a top nozzle 8. The lower spray arm 6 may rotatably be provided on the sump cover 42 and spray washing water toward the washing objects stored on the lower rack 51. The upper spray arm 7 may be arranged on the lower spray arm 6 and spray the washing water toward the washing objects stored on the upper rack 53. The top nozzle 8 may be provided on the top portion of the washing space 21 and may spray the washing water to the lower rack 51 and the upper rack 53. As described above, the first supply channel 461 may supply the washing water to the lower spray arm 6, and the second supply channel 463 may supply the washing water to the upper spray arm 7 and the top nozzle 8.

Hereinafter, a structure of the upper spray arm 7 will be described in more detail with reference to FIG. 2 to FIG. 11.

Figure 2:
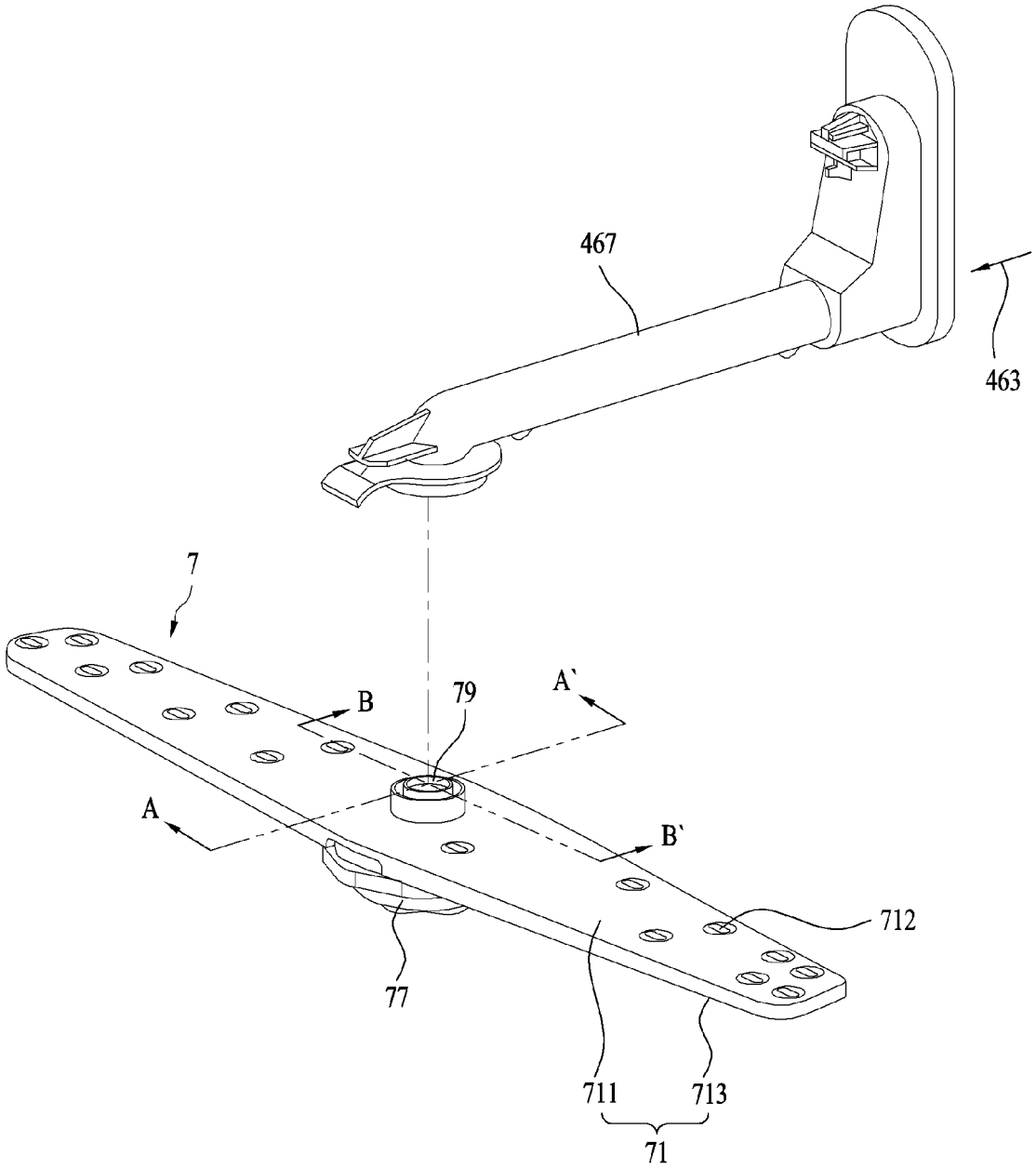
FIG. 2 is a view illustrating an example of an upper spray arm and an example of a spray arm holder.
Figure 3:
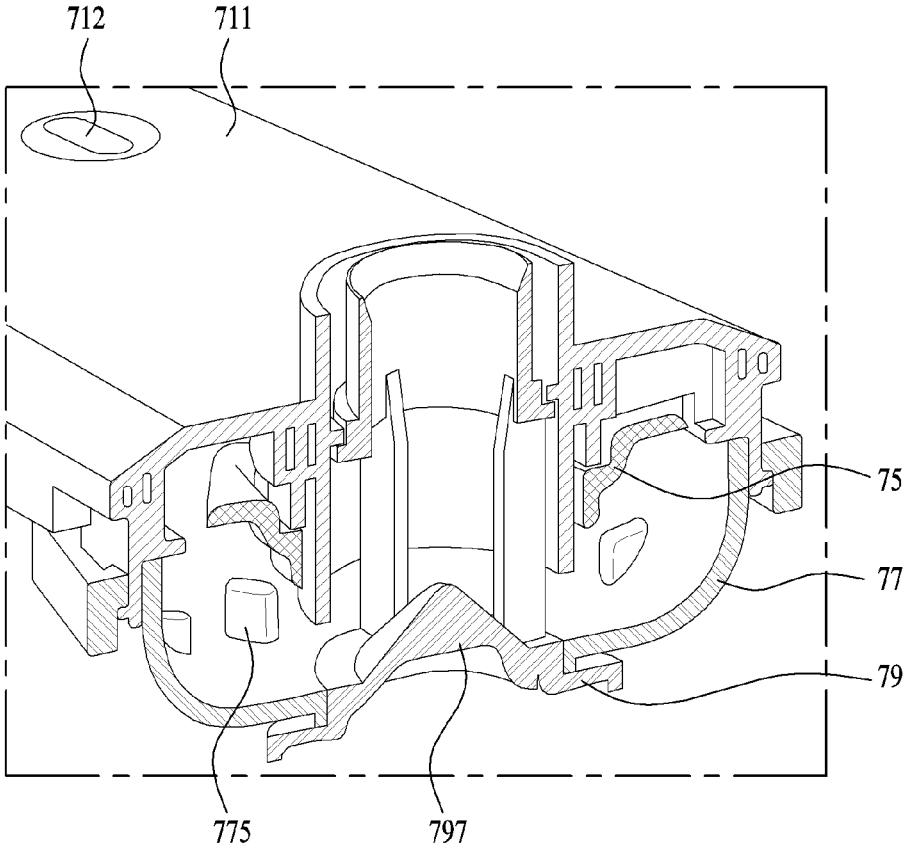
FIG. 3 is a cross-sectional view illustrating an example of an upper spray arm taken along line A-A' in FIG. 2.
Figure 4:
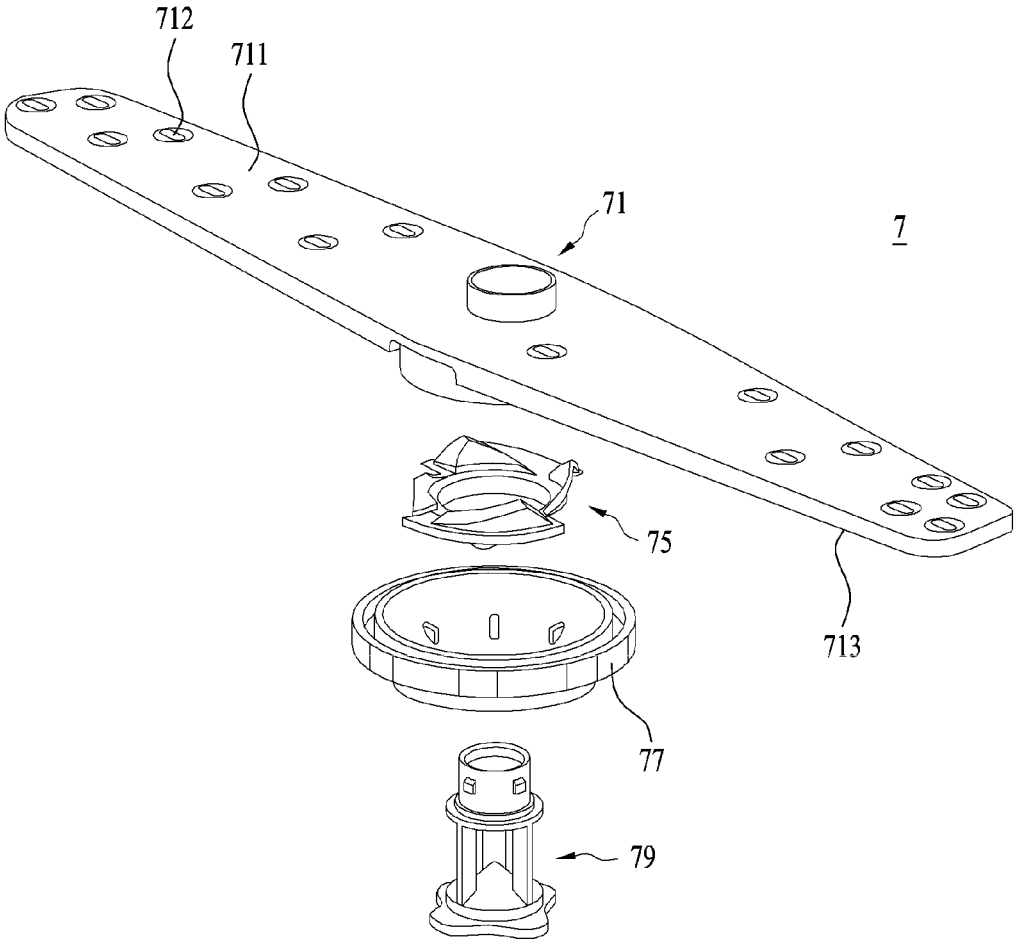
FIG. 4 is an exploded view illustrating the upper spay arm of FIG. 2.
Figure 5:
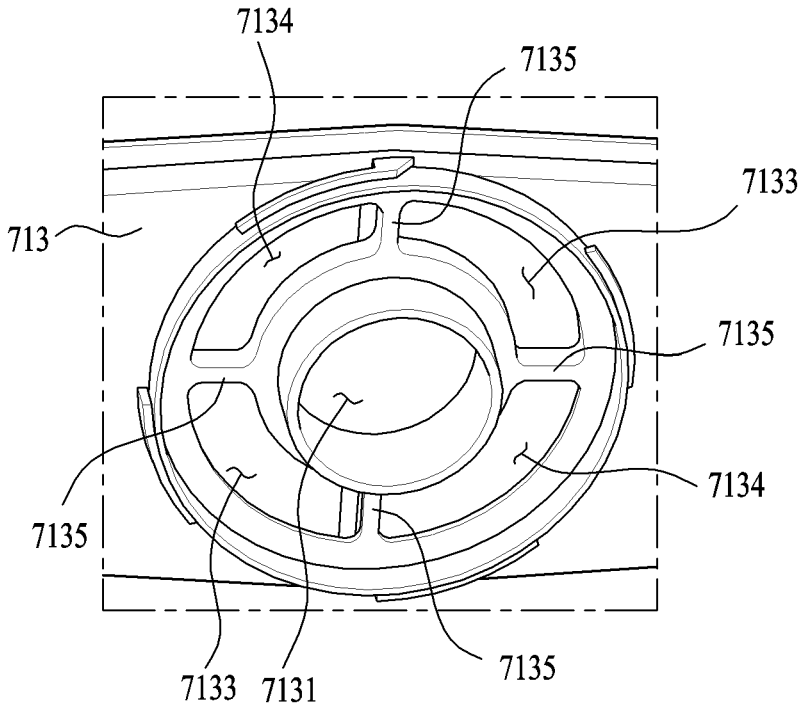
FIG. 5 is a partial bottom view illustrating an example of a lower body of FIG. 4.
Figure 6A:
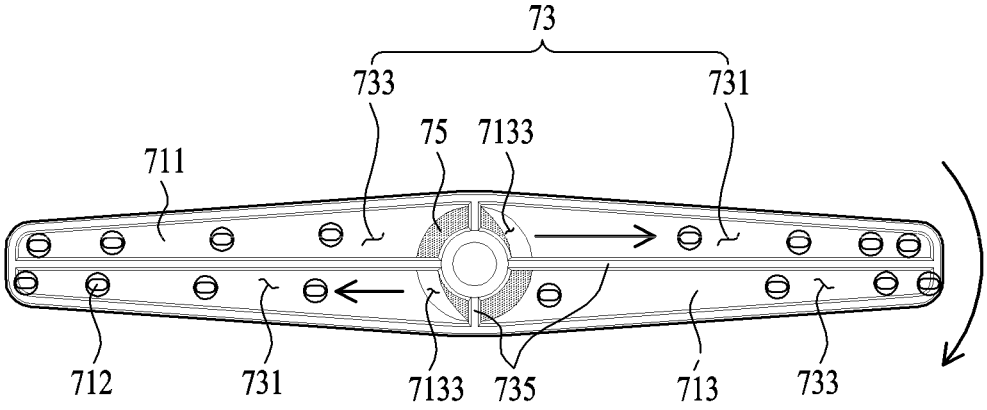
FIGS. 6A and 6B illustrate examples of rotation of an upper spray arm based on the supply direction of washing water.
Figure 6B:
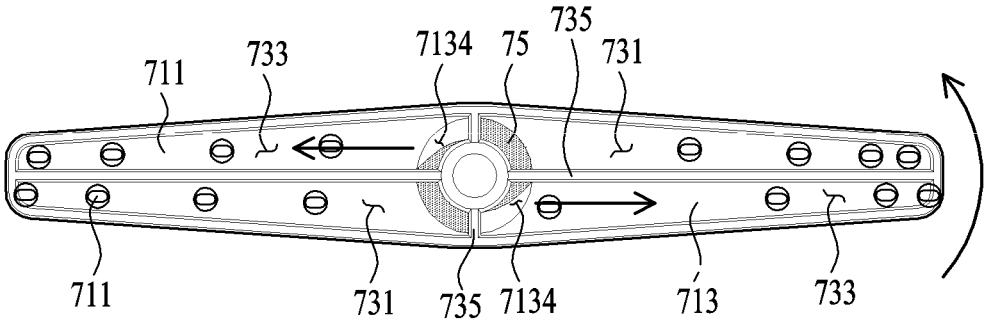
Figure 7:
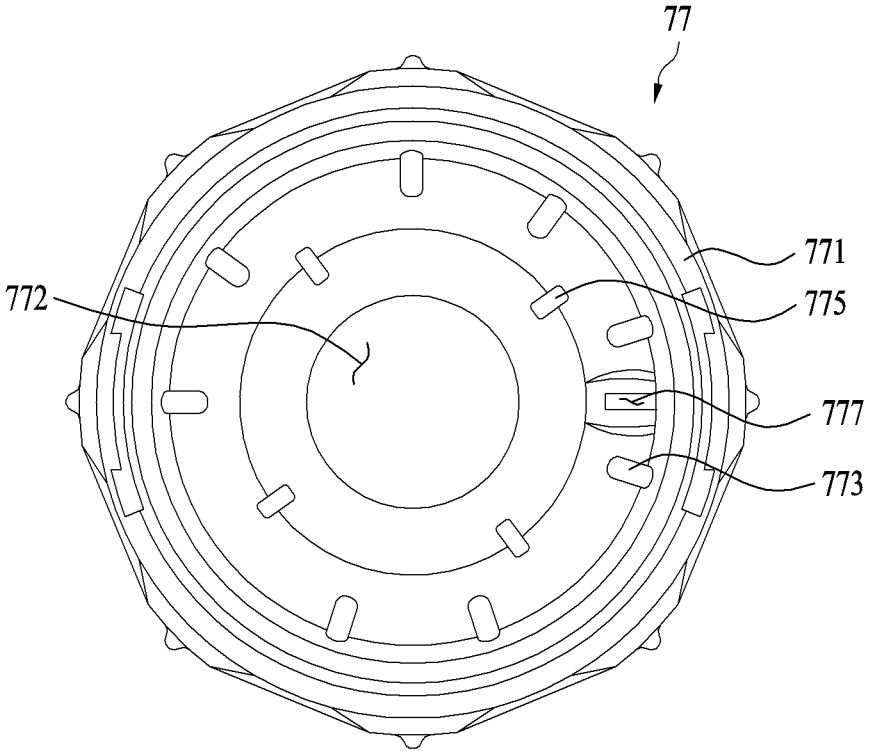
FIG. 7 is a plane view illustrating an example of a chamber of FIG. 4.
Figure 8:
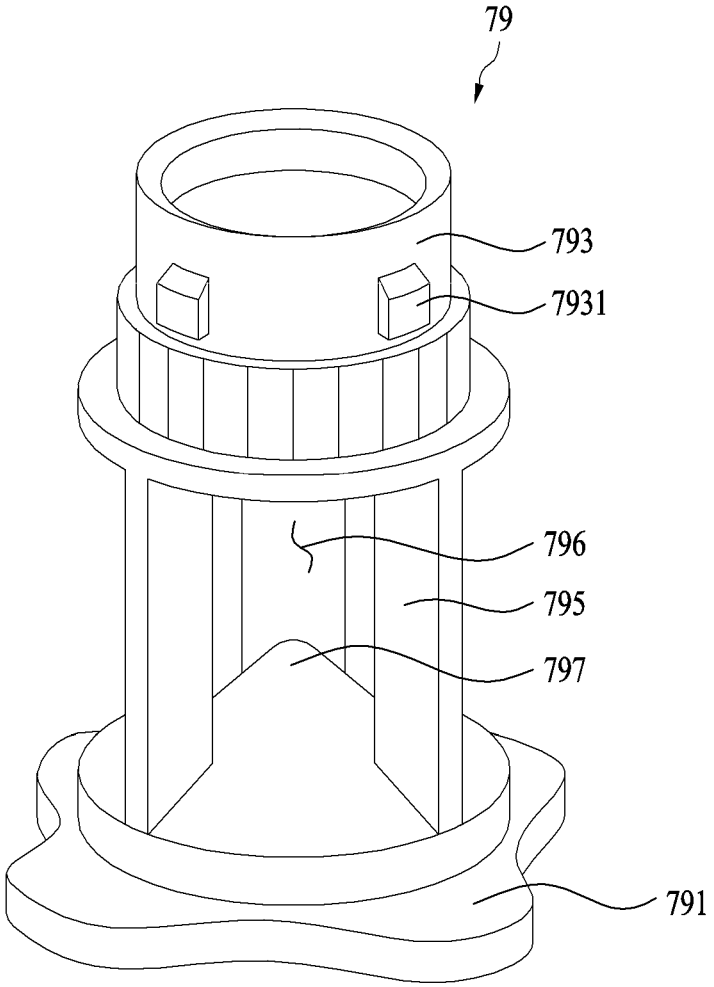
FIG. 8 is a perspective view illustrating an example of a channel guider of FIG. 4.
Figure 9:
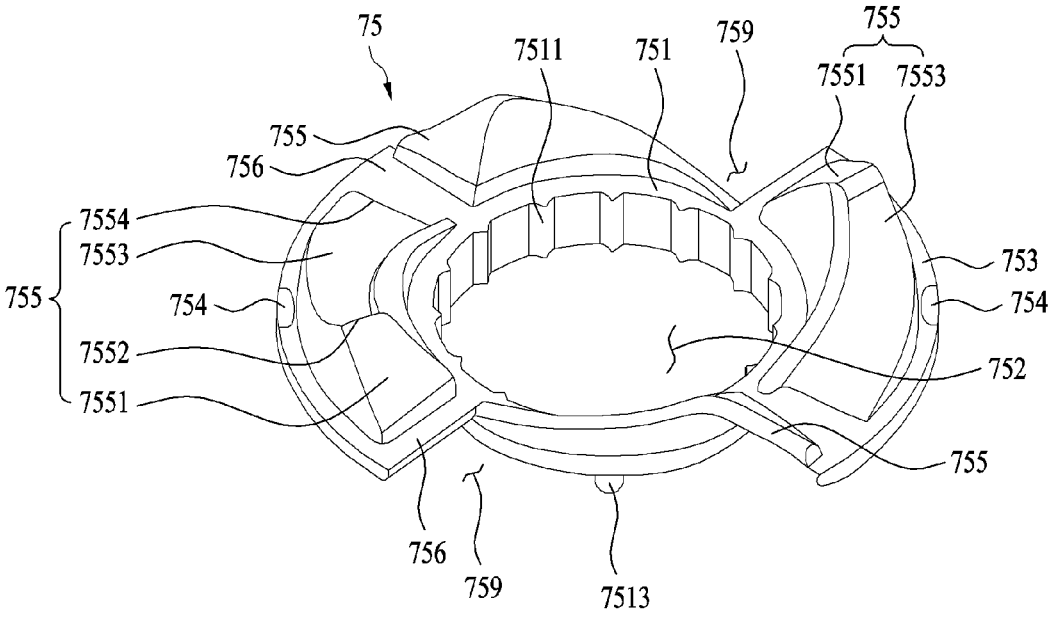
FIGS. 9 to 11 are views illustrating an example of a channel switch unit.
Figure 10:
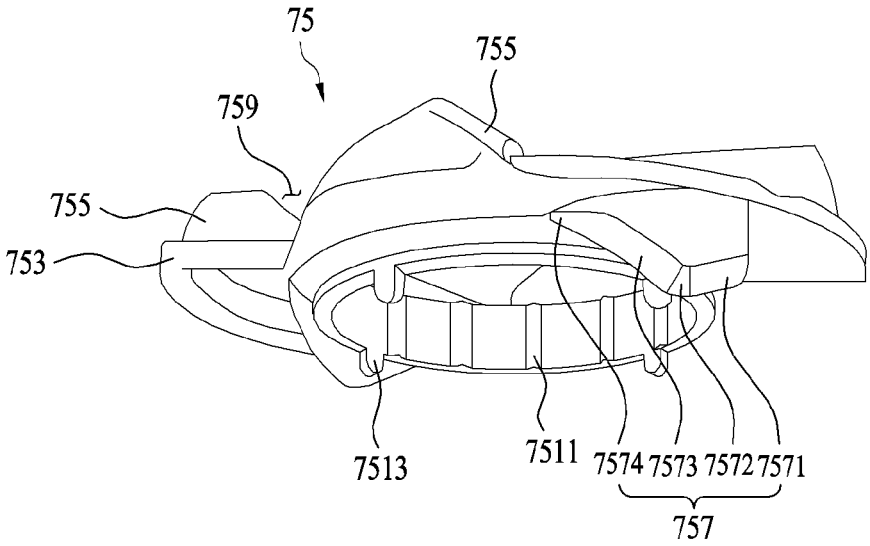
Figure 11:
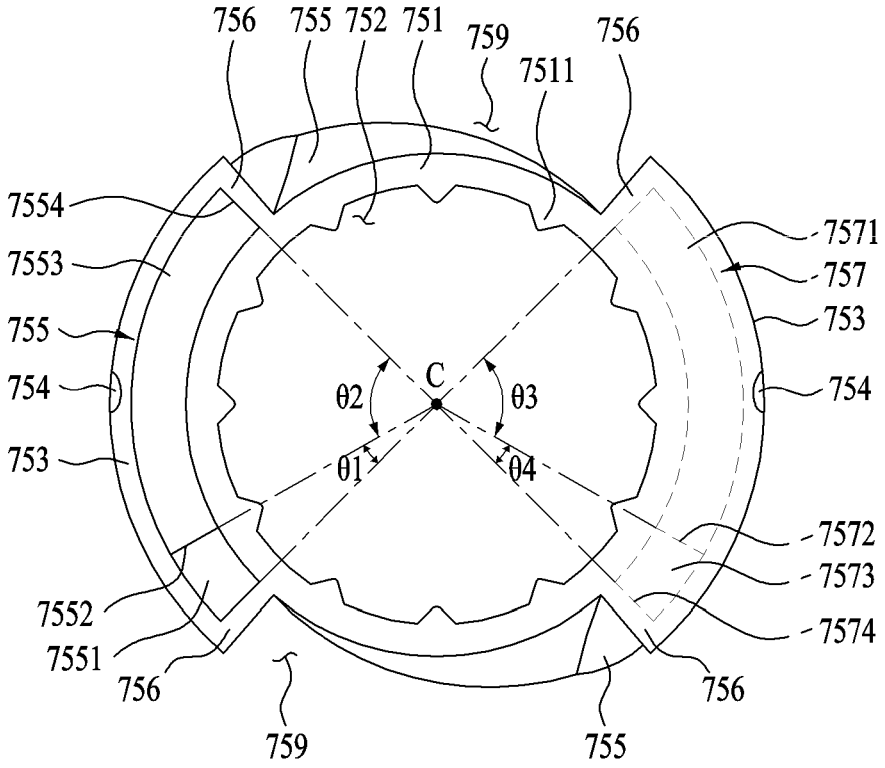

FIG. 2 is a view illustrating an example of an upper spray arm and an example of a spray arm holder. FIG. 3 is a cross-sectional view illustrating an example of an upper spray arm taken along line A-A' in FIG. 2. FIG. 4 is an exploded view illustrating the upper spay arm of FIG. 2. FIG. 5 is a partial bottom view illustrating an example of a lower body of FIG. 4. FIGS. 6A and 6B illustrate examples of rotation of an upper spray arm 7 based on the supply direction of washing water. Specifically, FIGS. 6A and 6B illustrate the upper spray arm 7 viewed from a top portion. FIG. 7 is a plane view illustrating an example of a chamber of FIG. 4. FIG. 8 is a perspective view illustrating an example of a channel guider of FIG. 4. FIGS. 9 to 11 are views illustrating an example of a channel switch unit of FIG. 4. FIG. 11 illustrates an example of a channel switch unit viewed from a top portion, and illustrates an example of an upper bump and an example of a lower bump that are disposed in each radial protrusion for convenience of description.

Referring to FIGS. 2 to 11, the upper spray arm 7 is rotatably coupled to the spray arm holder 467 connected to the second supply channel 463.

One end of the spray arm holder 467 may be fixed to an inner wall of the washing tub and the other end may be extended to the inside of the washing space 21 and arranged on the lower portion of the upper rack 53. The second supply channel 463 and a channel connected to the upper spray arm 7 may be provided inside of the spray arm holder 467. Therefore, washing water supplied through the second supply channel 463 may be supplied to the upper spray arm 7 through the spray arm holder 467.

The upper spray arm 7 is rotatably coupled to the lower portion of the spray arm holder 467. In this case, a channel guider 79 of the upper spray arm 7 is coupled with the spray arm holder 467, and an arm body 71 and a chamber 77 may be rotated around the channel guider 79. This will be described later.

The upper spray arm 7 includes an arm body 71 provided with a plurality of channels 73 therein, a chamber 77 coupled to a lower portion of the arm body 71, storing washing water, a channel guider 79 coupled to the spray arm holder by passing through the arm body 71 and the chamber 77, and a channel switch unit 75 provided in the chamber 77, selectively supplying the washing water to the plurality of the channels 73.

The arm body 71 may include an upper body 711 provided with a plurality of spray holes 712, and a lower body 713 coupled to the lower portion of the upper body 711, forming a washing water moving space. In this case, the washing water moving space may form a plurality of channels 73 by a plurality of partitions 735 (see FIG. 11). Washing water entering the channels 73 may be sprayed to the washing space 21 through the spray holes 712. In this case, the washing water may be sprayed by a water pressure formed inside the channels 73 even without using a separate power source.

In some implementations, a location, a shape, and the number of the spray holes 712 may be selected appropriately. A variety of spraying directions of washing water may be provided by various combinations of a location and a shape of the spray hole 712. Therefore, a spray area of washing water may be increased, and a washing power of the dishwasher 1 may be improved.

In some implementations, a spray hole may be defined on the lower body 713.

The lower body 713 may include a hollow tube 7131 into which the channel guider 79 is inserted, a plurality of chamber communication holes 7133 and 7134 formed outside the hollow tube 7131, and upper contact parts 7135 rotating the channel switch unit 75 when supplying washing water in contact with upper bumps 755 of the channel switch unit 75.

The hollow tube 7131 may be formed to pass through the lower body 713 and the upper body 711, and a coupling unit 793 of the channel guider 79 may be inserted to the hollow tube 7131. Therefore, an inner diameter of the hollow tube 7131 may be greater than an outer diameter of the hollow tube 7131. The coupling unit 793 may be inserted to the hollow tube 7131 and then coupled to the spray arm holder 467.

The chamber communication holes 7133 and 7134 are partitioned by the upper contact parts 7135, and may communicate the channels 73 inside the arm body 71 with the chamber 77. For example, the first chamber communication hole 7133 communicates a first channel 731 with the chamber 77, and the second chamber communication hole 7134 may communicate a second channel 733 with the chamber 77. On the other hand, the first chamber communication hole 7133 and the second chamber communication hole 7134 may sequentially be opened and closed based on rotation of the channel switch unit 75.

In some implementations, washing water may be sprayed in the direction of having a predetermined angle with a direction vertical to the top surface of the upper body 711. That is, the direction where washing water is sprayed from the spray holes 712 may not be a direction vertical to the top surface of the arm body 71. In this case, the arm body 71 of the upper spray arm 7 may be rotated using only a spray pressure of washing water without a separate driving device, and a rotating direction and a rotating speed of the upper spray arm 7 may be determined based on a spraying direction and a spray pressure of washing water.

For example, as shown in FIGS. 6A and 6B, a spraying direction of washing water may be changed depending on a location of the channel switch unit 75, and therefore a rotating direction of the upper spray arm 7 may also be changed.

In detail, as shown in FIG. 6A, in a state that the first chamber communication hole 7133 is opened, washing water may be supplied to the first channel 731 and the upper spray arm 7 may be rotated in a clockwise direction (hereinafter, referred to as "forward direction"). However, as shown in FIG. 6B, in a state that the second chamber communication hole 7134 is opened, the washing water may be supplied to the second channel 733 and the upper spray arm 7 may be rotated in a counterclockwise direction (hereinafter, referred to as "backward direction").

Therefore, when the first chamber communication hole 7133 and the second chamber communication hole 7134 are sequentially opened by repetition of ascending and descending of the channel switch unit 75, the upper spray arm 7 may alternately repeat a forward rotation and a backward rotation. In this case, a variety of spraying directions of washing water may be provided, and washing efficiency of the dishwasher 1 may be improved.

In some implementations, the arm body 71 may be formed to be upwardly inclined toward an outer side when viewed from the side. That is, the arm body 71 may be bent in a shape of V around the channel guider 79.

In this case, it will be advantageous not only to diversify a spraying angle of washing water but also to make a rotation of the arm body 71 more smoothly. That is, since the spraying direction of washing water and an extension direction of the arm body 71 are not orthogonal to each other even when the washing water is upwardly sprayed, a part of a counteraction force due to spraying of washing water may be used to rotate the arm body 71.

The chamber 77 may include a chamber body 771 in which a washing water storage space is formed, a chamber through hole 772 passing through the chamber body 771, and a supporting unit 773, lower contact parts 775 and a remnant water discharging unit 777 provided on the bottom inside the chamber body 771.

The chamber body 771 may be arranged on the lower portion of the lower body 713 and may temporarily store washing water to be supplied to the arm body 71. That is, washing water supplied from the second supply channel 463 to the channel guider 79 may be supplied to channels 73 inside the arm body 71 through the chamber body 771.

The chamber through hole 772 passes through the bottom of the chamber body 771, and the channel guider 79 may be inserted into the chamber through hole 772. That is, the coupling unit 793 of the channel guider 79 may be coupled to the spray arm holder 467 by sequentially passing through the chamber through hole 772 of the chamber 77 and the hollow tube 7131 of the arm body 71. Therefore, the chamber through hole 772 may be opened and closed by the guider body 791 of the channel guider 79.

The bottom of the chamber body 771 may rotatably be supported by the guider body 791 of the channel guider 79. At this time, since load of the arm body 71 and the chamber 77 is applied to the channel guider 79, water tight between the bottom of the chamber 77 and the guider body 791 may be maintained.

In some implementations, an opening having a diameter greater than that of the chamber through hole 772 may be formed on the top portion of the chamber body 771. Referring to FIG. 5 again, washing water inside the chamber 77 is supplied to the inside of the arm body 71 through the chamber communication holes 7133 and 7134 of the lower body. Therefore, in order that the washing water inside the chamber 77 is supplied to the arm body 71, the opening on the top portion of the chamber body should have a size that can cover the chamber communication holes 7133 and 7134. In some examples, since the chamber communication holes 7133 and 7134 are formed to be outer than the hollow tube 7131 into which the channel guider 79 is inserted, the opening should have a diameter greater than that of the chamber through hole 772 into which the channel guider 79 is inserted.

A plurality of the lower contact parts 775 may be provided on the bottom inside the chamber body 771, and a plurality of the supporting units 773 may be provided to be outer than the lower contact parts 775 in a radial direction. Since the lower contact parts 775 and the supporting units 773 have a bump shape protruded from the bottom of the chamber body 771, internal capacity of the chamber 77 may not be reduced.

The lower contact parts 775 may rotate the channel switch unit 75 in contact with lower bumps 757 of the channel switch unit 75, which will be described later. In more detail, when supply of washing water to the second supply channel 463 is stopped, the channel switch unit 75 descends inside the chamber 77, and in this case, the lower bumps 757 of the channel switch unit 75 slide along with the lower contact parts 775. Therefore, the channel switch unit 75 may be rotated with a predetermined angle while descending. In this case, the lower contact parts 775 may be formed with the number corresponding to the number of the lower bumps 757 of the channel switch unit 75.

The supporting unit 773 may be in contact with the bottom of the radial protrusion 753 when the channel switch unit 75 descends. In this case, the radial protrusion 753 and the chamber body 771 are spaced apart from each other by the supporting unit 773, whereby washing water for forming buoyancy may enter the lower portion of the radial protrusion 753. Also, as a plurality of the supporting units 773 with the same height are provided, the channel switch unit 75 may be mounted in the chamber body 771 in parallel with the ground.

The remnant water discharging unit 777 may be formed to pass through the bottom surface of the chamber 77. The remnant water discharging unit 777 may prevent washing water from remaining inside the chamber 77 when supply of the washing water to the second supply channel 463 is stopped. Also, while the washing water is supplied to the second supply channel 463, a part of washing water inside the chamber 77 may be sprayed toward the lower rack 51 through the remnant water discharging unit 777. Therefore, a spraying direction of washing water may be diversified and washing performance of the dishwasher 1 may be improved.

The channel guider 79 may fixedly be coupled to the spray arm holder 467 and may rotatably support the arm body 71 and the chamber 77. That is, the channel guider 79 may be coupled to the spray arm holder 467 by passing through the chamber 77 and the arm body 71, and the arm body 71 and the chamber 77 may be rotated around the channel guider 79 together.

The channel guider 79 may include a guider body 791 for closing the chamber through hole 772 in contact with the bottom of the chamber 77, an extension unit 795 extended from the top surface of the guider body 791 to the upper direction and inserted into the chamber through hole 772, and a coupling unit 793 provided on a top portion of the extension unit 795 and coupled to the spray arm holder 467 by passing through the hollow tube 7131 of the arm body 71.

The guider body 791 may rotatably support the chamber 77 and the arm body 71. Also, the guider body 791 may close the chamber through hole 772 to prevent washing water from leaking. In this case, since weights of the chamber 77 and the arm body 71 are applied to the guider body 791, water tight between the chamber through hole 772 and the guider body 791 is maintained as described above.

Although the channel guider 79 is fixed to the spray arm holder 467, since the arm body 71 and the chamber 77 are rotated around the channel guider 79, a large frictional force may act on a portion where the arm body 71 and the chamber 77 are in contact with the channel guider 79. In this case, since the arm body 71, the chamber 77, and the channel guider 79 are easily worn out, washing water may not be sprayed smoothly. In some implementations, the channel guider 79 may be made of a material different from that of each of the chamber 77 and the arm body 71. Unlike this, the channel guider 79, the arm body 71 and the chamber 77 may be made of the same material, or may be made of their respective materials different from one another.

In some implementations, a bump 797 for uniformly distributing washing water supplied to the channel guider 79 to the chamber 77 may be provided in the guider body 791. The bump 797 is upwardly protruded from the top surface of the guider body 791, and may have a conical shape with a more protruded center portion. Unlike this, the bump 797 may have various shapes such as a triangular pyramid shape, a quadrangular pyramid shape, a cylindrical shape, and a square pillar shape.

One end of the spray arm holder 467 is bent to be connected with the coupling unit 793 of the channel guider 79. In this case, since a moving direction of washing water moving inside the spray arm holder 467 in parallel with the ground is changed from the bent portion to a direction vertical to the ground, a flow velocity becomes non-uniform due to an inertial force.

Therefore, flow distribution of washing water is non-uniformly formed inside the channel guider 79 connected to the spray arm holder 467, and washing water may enter the inside of the chamber 77 in a state that the washing water is concentrated on one side. As a result, a water pressure applied to the channel switch unit 75 is not uniform, whereby the channel switch unit 75 may ascend in a state that it is inclined, and washing water may not be smoothly supplied to the arm body 71 through the chamber communication holes 7133 and 7134.

In order to solve this problem, in the present disclosure, the bump 797 upwardly protruded is formed on the top surface of the guider body 791. The bump 797 may uniformly distribute washing water into an inner space of the chamber 77 by dispersing washing water entering the channel guider 79.

The coupling unit 793 has a cylinder shape, and may be provided with a plurality of coupling bumps 7931 on an outer circumferential surface. In some implementations, the spray arm holder 467 may be provided with grooves corresponding to the coupling bumps 7931. In some examples, the coupling bumps 7931 may be rigidly fix the coupling unit 793 to the spray arm holder 467. Therefore, if the coupling bumps 7931 are to couple the coupling unit 793 to the spray arm holder 467, the coupling bumps 7931 may be modified to various shapes.

The channel guider 79 may rigidly be fixed to the spray arm holder 467 by the coupling unit 793, and may not be rotated even when washing water is sprayed.

The extension unit 795 may include a plurality of columns for connecting the guider body 791 with the coupling unit 793. The columns are arranged to be spaced apart from each other, and an exhaust hole 796 is formed between the columns. That is, washing water entering the channel guider 79 may be dispersed by the bumps 797, and may be supplied to the inner space of the chamber 77 through the exhaust hole 796 formed between the extension units 795.

In some implementations, as the extension unit 795 is closer to the bump 797, its width may be narrower so as not to interrupt a flow of washing water.

In some implementations, if the extension unit 795 has a square pillar shape as shown in FIG. 8, a width of one surface of the extension unit 795 headed for the bump 797 may be smaller than that of a side adjacent thereto. As a result, interruption of the flow of washing water may be minimized.

The channel switch unit 75 is rotatably accommodated in the chamber 77. If washing water is supplied to the inside of the chamber 77, the channel switch unit 75 ascends, and if the flow of washing water to the chamber 77 is stopped, the channel switch unit 75 descends. At this time, the channel switch unit 75 may selectively open and close the chamber communication holes 7133 and 7134 formed in the lower body 713 while being rotated as much as a certain angle. Therefore, the washing water may selectively be supplied to a part of the channels 731 and 733.

As shown in FIGS. 9 to 11, the channel switch unit 75 may include a switch body 751 provided with a hollow tube insertion hole 752, radial protrusions 753 and channel openings 759, which are alternately formed outside of the switch body 751, upper bumps 755 provided on the switch body 751, and lower bumps 757 provided on the bottom of the radial protrusions 753.

The switch body 751 has a ring shape of a predetermined thickness, and is provided with a hollow tube insertion hole 752 therein. The switch body 751 is provided to surround an outer circumferential surface of the hollow tube 7131 of the lower body 713. Therefore, the hollow tube insertion hole 752 should have a diameter greater than an outer diameter of the hollow tube 7131.

In some examples, the channel switch unit 75 may slide up and down inside the chamber 77 along the outer circumferential surface of the hollow tube 7131. Therefore, in the case that the hollow tube insertion hole 752 has a diameter equal to the outer diameter of the hollow tube 7131 or is formed to have a minimum tolerance, the channel switch unit 75 may not ascend and descend smoothly due to a friction between the switch body 751 and the hollow tube 7131.

In the case where the hollow tube insertion hole 752 is formed to have a diameter too greater than the outer diameter of the hollow tube 7131, the channel switch unit 75 may ascend in a state that the channel switch unit 75 is inclined. Also, as the case may be, rolling may occur in which vertical displacement is alternately changed when the channel switch unit 75 ascends. In this case, the channel switch unit 75 is not normally settled down in the upper contact parts 7135, whereby washing water may not be smoothly supplied to the arm body 71 through the chamber communication holes 7133 and 7134.

In order to solve this problem, in the present disclosure, a plurality of support bumps 7511 protruded toward the hollow tube insertion hole 752 are formed in the switch body 751. The support bumps 7511 may reduce a friction between the channel switch unit 75 and the hollow tube 7131 in contact with the outer circumferential surface of the hollow tube 7131. That is, a contact type between the channel switch unit 75 and the hollow tube 7131 is changed from surface contact to a point contact. Therefore, the channel switch unit 75 may stably ascend and descend.

A plurality of spacers 7513 may be provided on the bottom of the switch body 751. The spacers 7513 may be protruded to have a predetermined height on the bottom of the switch body 751, and may be spaced apart from each other. As the spacers 7513 are provided on the bottom of the switch body 751, a minimum gap may be maintained between the bottom of the switch body 751 and the bottom of the chamber 77. The gap is to supply washing water to the lower portion of the radial protrusions 753.

In detail, if the channel switch unit 75 ascends to the maximum inside the chamber 77, the spacer 7513 is in contact with the bottom of the chamber 77. Therefore, the bottom of the switch body 751 may not be in contact with the bottom of the chamber 77, and a certain gap may be maintained between the switch body 751 and the bottom of the chamber 77 (see FIG. 10). Therefore, washing water may be supplied to the lower portion of the radial protrusions 753 through the gap.

The radial protrusions 753 may be formed to be protruded in a radius direction outside a top portion of the switch body 751, and may have a thickness thinner than that of the switch body 751. In this case, the bottom of the radial protrusions 753 is arranged to be higher than that of the switch body 751. Therefore, even though the channel switch unit 75 descends to the maximum, the bottom of the radial protrusions 753 may be spaced apart from the bottom of the chamber 77. In this way, the case that the bottom of the radial protrusions 753 is spaced apart from the bottom of the chamber 77 is to generate buoyancy for increasing the channel switch unit 75 by supplying washing water to the lower portion of the radial protrusions 753.

The radial protrusions 753 are provided such that a plurality of radial protrusions are spaced apart from one another, and portions between the respective radial protrusions 753 adjacent to each other become the channel openings 759. At this time, the number of the radial protrusions 753 and the number of the channel openings 759 may be changed depending on the number of the channels 73 formed in the arm body 71. For example, in the case that two first channels 731 and two second channels 733 are formed inside the arm body 71 (see FIGS. 6A and 6B), two radial protrusions 753 and two channel openings 759 may be provided in the channel switch unit 75 (see FIGS. 9 to 11). In this case, one channel of the first channels 731 and the second channels 733 may be closed by the radial protrusions 753, and the other one channel may be opened by the channel openings 759. Therefore, washing water may be supplied to only one channel selected from the first channels 731 and the second channels 733.

The upper bumps 755 may respectively be provided on the radial protrusions 753 and the channel openings 759. At this time, the upper bump provided on the channel openings 759 is substantially equal to or similar to the upper bump provided on the radial protrusions 753 except that its width gradually becomes narrower so as not to interrupt movement of washing water.

In some examples, since the upper bumps 755 rotate the channel switch unit 75 in contact with the upper contact parts 7135 when the channel switch unit 75 ascends, the number of the upper bumps 755 may be provided to correspond to the number of the upper contact parts 7135.

A structure of the upper bumps 755 will be described in more detail with reference to FIGS. 9 to 11. The upper bumps 755 include a first inclined surface 7551 having a height increased at a first gradient, and a second inclined surface 7553 connected to the first inclined surface 7551, having a height reduced at a second gradient. The first inclined surface 7551 may be extended as much as a first angle θ1 around the center C of the switch body 751, and the second inclined surface 7553 may be extended as much as a second angle θ2 around the center C of the switch body 751.

At this time, one end of the second inclined surface 7553, which is in contact with the first inclined surface, is defined as a first contact portion 7552, and the other end of the second inclined surface 7553 is defined as a second contact portion 7554. Also, a part of the radial protrusions 753 arranged between the upper bumps 755 adjacent to each other will be defined as a settling portion 756. That is, the height of the upper bump 755 is gradually increased from the settling portion 756 toward the first contact portion 7552 (first inclined surface 7551), and is gradually reduced from the first contact portion 7552 toward the second contact portion 7554 (second inclined surface 7553).

If washing water is supplied into the chamber 77, the channel switch unit 75 ascends. The first contact portion 7552 is in contact with the upper contact parts 7135. Afterwards, if the amount of washing water supplied to the inside of the chamber 77 is increased, buoyancy applied to the channel switch unit 75 may also be increased. The channel switch unit 75 is rotated by such buoyancy, and the upper contact parts 7135 slide on the second inclined surface 7553. The channel switch unit 75 is rotated until the upper contact parts 7135 reach the second contact portion 7554, and the upper contact parts 7135 may finally be settled down on the settling portion 756. At this time, the upper bump 755 is inserted into the chamber communication holes 7133 and 7134.

In this way, when washing water is supplied, the channel switch unit 75 may ascend while being rotated as much as an angle corresponding to at least an extension angle θ2 (second angle) of the second inclined surface 7553.

If the flow of washing water to the chamber 77 is stopped, buoyancy applied to the radial protrusions 753 is removed, and the channel switch unit 75 descends by its load. At this time, the upper contact parts 7135 slide on the first inclined surface 7551. Therefore, the channel switch unit 75 may descend while being rotated.

In some implementations, the second gradient may be gentler than the first gradient. That is, when viewed from the top surface, the second angle θ2 may be greater than the first angle θ1.

The amount of washing water supplied into the chamber 77 may be linearly gradually increased. However, since a size of buoyancy for ascending the channel switch unit 75 is proportional to the supply amount of washing water, a height of the second inclined surface 7553 may be slowly increased (second gradient).

In some cases, when the supply of washing water is stopped, the amount of washing water may be rapidly reduced, whereby the height of the first inclined surface 7551 may rapidly be reduced (first gradient).

The lower bumps 757 may be disposed below the radial protrusions 753, and may rotate the channel switch unit 75 in contact with the lower contact parts 775 when the channel switch unit 75 descends.

The lower bumps 757 include a third inclined surface 7571 having a height increased at a third gradient, and a fourth inclined surface 7573 having a height reduced at a fourth gradient. At this time, the height of the inclined surface is defined as a distance downwardly protruded around the bottom of the radial protrusions 753.

That is, the third inclined surface 7571 may be extended as much as a third angle θ3 around the center C of the switch body 751, and the fourth inclined surface 7573 may be extended as much as a fourth angle θ4 around the center C of the switch body 751.

At this time, one end of the fourth inclined surface 7573 which is in contact with the third inclined surface 7571 is defined as a third contact portion 7572, and the other end of the fourth inclined surface 7573 is defined as a fourth contact portion 7574. Also, a portion of the radial protrusions 753 arranged between the upper bumps 755 adjacent to each other is defined as a settling portion 756. That is, the height of the lower bumps 757 is gradually increased from the settling portion 756 toward the third contact portion 7572 (third inclined surface 7571), and is gradually reduced from the third contact portion 7572 toward the fourth contact portion 7574 (fourth inclined surface 7573).

If the flow of washing water to the chamber 77 is stopped, gravity applied to the channel switch unit 75 becomes greater than buoyancy. Therefore, the channel switch unit 75 descends, and the third contact portion 7572 is in contact with the lower contact parts 775. Afterwards, if descending of the channel switch unit 75 continues, the channel switch unit 75 is rotated by gravity applied to the channel switch unit 75. Therefore, the lower contact part 775 slides on the fourth inclined surface 7573. The channel switch unit 75 is rotated until the lower contact part 775 reaches the fourth contact portion 7574, and the lower contact parts 775 are finally in contact with the bottom of the settling portion 756.

In this way, if supply of washing water is stopped, the channel switch unit 75 may descend while being rotated as much as an angle corresponding to at least an extension angle θ4 (fourth angle) of the fourth inclined surface.

As a result, the channel switch unit 75 is rotated as much as an angle corresponding to a sum of the second angle θ2 and the fourth angle θ4 through ascending and descending of one time.

In some implementations, the sum of the second angle θ2 and the fourth angle θ4 may be 90°.

For example, the second angle θ2 may be 60°, and the fourth angle θ4 may be 30°. In this case, the channel switch unit 75 may be rotated as much as 60° during ascending, and may be rotated as much as 30° during descending. As a result, the channel switch unit 75 may be rotated as much as 90° through ascending and descending of one time. Therefore, in some implementations, where the channel openings 759 are spaced apart from each other at 180° and four chamber communication holes 7133 and 7134 are provided in the lower body 713 at an interval of 90° (see FIG. 5), the channel switch unit 75 may sequentially open the first chamber communication hole 7133 and the second chamber communication hole 7134.

At least one outflow groove 754 may be provided outside the radial protrusions 753. The outflow groove 754 is an element for partially supplying washing water to a closed channel in a state that the channel switch unit 75 ascends. This will be described later with reference to FIG. 13.

Hereinafter, a procedure of spraying washing water through the upper spray arm 7 will be described in more detail with reference to FIGS. 12A, 12B, and 13.

Figure 12A:
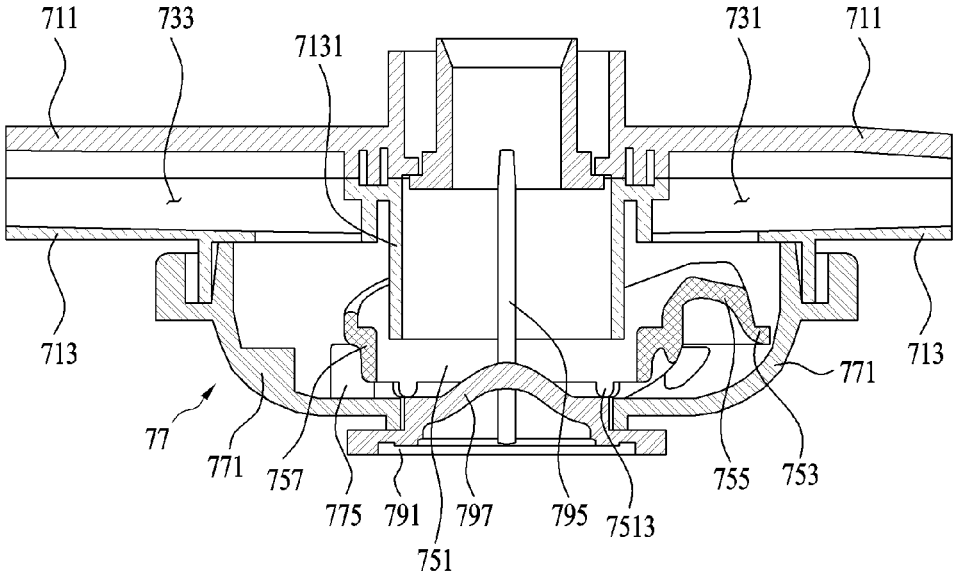
FIGS. 12A and 12B are partial cross-sectional views illustrating an example of an upper spray arm of FIG. 2, taken along line B-B', and illustrate an example operation of a channel switch unit based on supply of washing water.
Figure 12B:
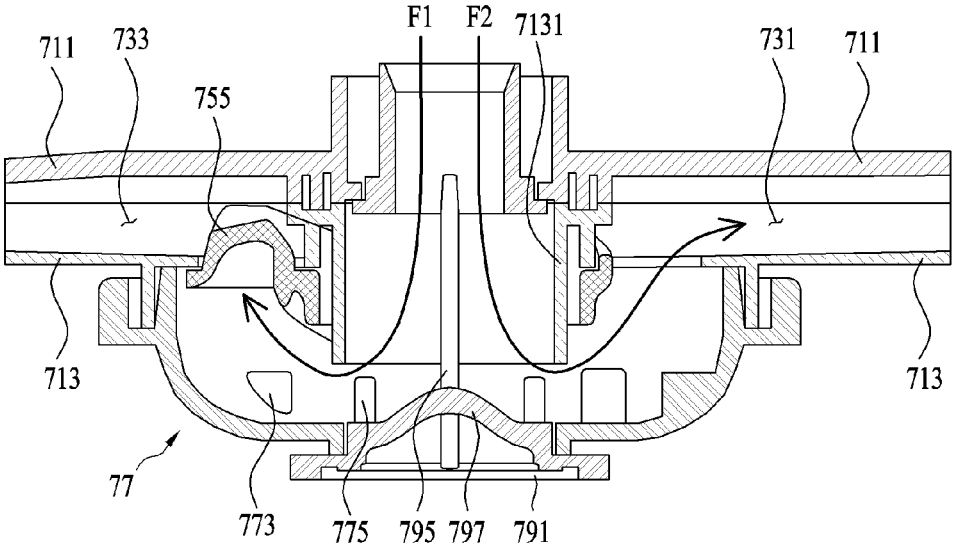
Figure 13:
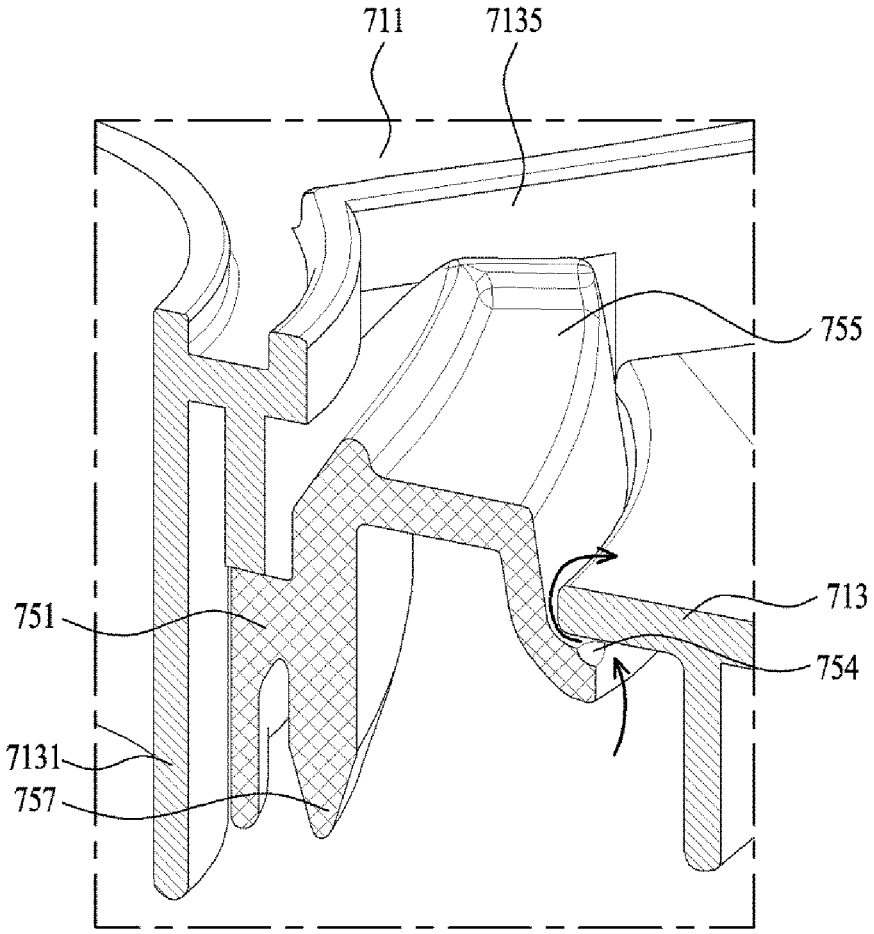
FIG. 13 is a partial cross-sectional view illustrating an example of an outflow groove defined at a channel switch unit.

FIGS. 12A and 12B are partial cross-sectional views illustrating an example of an upper spray arm in FIG. 2, taken along line B-B', and illustrates an operation of a channel switch unit based on supply of washing water, and FIG. 13 is a partial cross-sectional view illustrating an example of an outflow groove of a channel switch unit.

Referring to FIG. 12A, when washing water is not supplied to the second supply channel 463, the washing water does not enter the inside of the chamber 77. In this case, the channel switch unit 75 is settled down on the bottom of the chamber 77. In detail, the lower bumps 757 are in contact with the lower contact parts 775, and the radial protrusions 753 is in contact with the supporting unit 773. Also, the spacers 7513 are in contact with the bottom of the chamber 77, and the bottom of the switch body 751 is spaced apart from the bottom of the chamber 77.

Afterwards, if washing water is supplied, as shown in FIG. 12B, the channel switch unit 75 ascends while being rotated in the chamber 77.

The washing water entering the inside of the chamber 77 is supplied to the lower portion of the radial protrusions 753 through the gap formed between the bottom of the switch body 751 and the bottom of the chamber 77. When buoyancy applied to the radial protrusions 753 reaches more than load of the channel switch unit 75, the channel switch unit 75 ascends. At this time, as the upper bumps 755 slide while being engaged with the upper contact parts 7135 of the lower body 713, the channel switch unit 75 may be rotated.

If ascending of the channel switch unit 75 is completed, the upper bumps 755 are inserted into any one of the first chamber communication hole 7133 and the second chamber communication hole 7134. FIG. 12B and FIG. 6A illustrate that the upper bumps 755 are inserted into the second chamber communication hole 7134. In this case, the second chamber communication hole 7134 is closed by the radial protrusions 753, and the first chamber communication hole 7133 is opened by being communicated with the channel openings 759. Therefore, a flow F1 of washing water to the second channel 733 may be blocked, and a flow F2 of washing water to only the first channel 731 may be performed. Therefore, the upper spray arm 7 may be rotated clockwise.

If supply of washing water is stopped, the channel switch unit 75 again descends. In this case, as the lower bumps 757 slide while being engaged with the lower contact parts 775 of the chamber 77, the channel switch unit 75 may be rotated.

Afterwards, if supply of washing water is resumed, the channel switch unit 75 is again rotated and ascends. In this case, since the channel switch unit 75 has been subjected to descending and ascending of one time after the status shown in FIG. 12B, the channel switch unit 75 may be the state that it is rotated as much as 90°.

That is, unlike the example shown in FIG. 12B, the first chamber communication hole 7133 is closed by the radial protrusions 753, and the second chamber communication hole 7134 is opened to be communicated with the channel openings 759 (see FIG. 6B). Therefore, the flow of washing water to the first channel 731 may be blocked, and the washing water may flow to only the second channel 733. Therefore, the upper spray arm 7 may be rotated counterclockwise.

In this way, if supply and stop of washing water are repeated, the washing water may alternately be supplied to the first channel 731 and the second channel 733. Therefore, the upper spray arm 7 may spray the washing water while repeating clockwise rotation and counterclockwise rotation.

Referring to FIG. 12B, in a state that the channel switch unit 75 completely ascends, the washing water is not supplied to the second channel 733. Even though the washing water supplied to the second channel partially remains in a previous step, the washing water fully flows out through the spray holes 712 by a centrifugal force during rotation of the arm body 71. That is, there is no washing water in the second channel 733.

In this state, if supply of the washing water to the chamber 77 is stopped, a water level in the chamber 77 is gradually lowered and the channel switch unit 75 descends. However, as described above, since there is no washing water in the second channel 733, there is no force for pushing the radial protrusions 753. That is, the channel switch unit 75 descends by depending on its load.

Therefore, if mass of the channel switch unit 75 is small, the channel switch unit 75 may descend very slowly. In some examples, supply of the washing water may be resumed in a state that the channel switch unit 75 does not descend completely.

If the channel switch unit 75 again ascends in a state that descending of the channel switch unit 75 is not completed, the channel switch unit 75 may not be rotated as much as a set angle. That is, as the channel 73 is not changed, the upper spray arm 7 may continuously be rotated in one direction only. Alternatively, as the washing water is supplied to every channel 73, the upper spray arm 7 may not be rotated.

In some implementations, an outflow groove 754 may be defined at an outside the radial protrusions 753. As shown in FIG. 13, the outflow groove 754 may increase a descending speed of the channel switch unit 75 by allowing the radial protrusions 753 to partially block the washing water.

In detail, the chamber communication holes 7133 and 7134 may not be completely closed even though the channel switch unit 75 completely ascends. That is, the washing water may partially be supplied to a channel, which is blocked, through the outflow groove 754. In this case, the 'blocked channel' refers to a channel to which the upper bump 755 is inserted and that may not be completely blocked.

In this way, if a small portion of washing water may be continuously supplied to the blocked channel through the outflow groove 754, the washing water supplied through the outflow groove 754 may push the radial protrusions 753 when supply of the washing water is stopped. Therefore, a descending speed of the channel switch unit 75 may be increased, and the channel switch unit 75 may completely descend before supply of washing water is resumed.

A position, a shape and the number of the outflow grooves 754 may diversely be selected depending on factors such as a material and a shape of the channel switch unit 75 and a supply cycle of washing water.

In some examples, the structure of the aforementioned upper spray arm 7 may substantially equally or similarly be applied to the lower spray arm 6.

In some implementations, the upper spray arm 7 may spray washing water downwardly, upwardly, or both.

What is claimed is:

1. A dishwasher comprising:

a washing tub configured to receive washing objects;

a spray arm rotatably disposed in the washing tub and configured to spray washing water toward the washing objects; and a spray arm holder that defines a supply channel configured to supply washing water to the spray arm, wherein the spray arm includes:

an arm body that defines:

a plurality of channels that are partitioned from each other and that are configured to carry washing water, and a plurality of spray holes configured to discharge washing water from the plurality of channels toward the washing objects, a chamber disposed vertically below the arm body and configured to communicate with the plurality of channels, a channel guider configured to supply washing water from the spray arm holder to the chamber, and a channel switch unit accommodated in the chamber and configured to alternatively open and close the plurality of channels.

2. The dishwasher of claim 1, wherein the channel guider passes through the arm body and the chamber to couple to the spray arm holder, and is configured to rotatably support the arm body and the chamber.

3. The dishwasher of claim 2, wherein the channel guider includes:

a guider body disposed vertically below the chamber and configured to support the chamber and the arm body;

an extension unit that extends upwardly from the guider body and passes through the chamber, the extension unit defining a plurality of exhaust holes configured to supply washing water into the chamber; and a coupling unit that is disposed at a top portion of the extension unit, that passes through the arm body to couple to the spray arm holder, and that is configured to receive washing water from the spray arm holder.

4. The dishwasher of claim 3, wherein the guider body includes a bump that protrudes from a top surface of the guider body and that is configured to distribute washing water entering the extension unit toward the chamber.

5. The dishwasher of claim 3, wherein the coupling unit includes coupling bumps that protrude from an outer circumferential surface of the coupling unit and that are configured to couple to the spray arm holder.

6. The dishwasher of claim 1, wherein the channel switch unit is configured to move upward and downward along a longitudinal direction of the channel guider and to rotate within a predetermined angle about the channel guider based on moving upward and downward along the longitudinal direction.

7. The dishwasher of claim 6, wherein the channel switch unit includes:

a switch body configured to move upward and downward along an outer circumferential surface of the channel guider;

a plurality of radial protrusions that protrude from the switch body in a radius direction of the switch body and that are configured to cause the switch body to move upward based on buoyancy of washing water entering the chamber; and a plurality of channel openings, each channel opening being defined between the radial protrusions.

8. The dishwasher of claim 7, wherein the arm body defines a plurality of chamber communication holes that is configured to communicate with the plurality of channels and the chamber, and wherein the radial protrusions are configured to, based on the channel switch unit moving upward, be inserted into a part of the chamber communication holes and block the part of the chamber communication holes to thereby restrict supply of washing water to the plurality of channels.

9. The dishwasher of claim 8, wherein the radial protrusions define an outflow groove recessed from an outside of the radial protrusions in the radius direction.

10. The dishwasher of claim 9, wherein the outflow groove is configured to, in a state in which the radial protrusions are inserted into the chamber communication holes, allow a portion of washing water in the chamber to enter the corresponding channel to thereby increase a descending speed of the channel switch unit.

11. The dishwasher of claim 8, wherein the arm body further includes a hollow tube that extends downwardly from the arm body and that receives the channel guider, and wherein the switch body further includes a plurality of support bumps that protrude from an inner circumferential surface of the switch body toward an outer circumferential surface of the hollow tube.

12. The dishwasher of claim 8, wherein the switch body further includes a plurality of spacers that protrude from a bottom surface of the switch body toward the chamber and that define a space between the bottom surface of the switch body and the chamber.

13. The dishwasher of claim 12, wherein the arm body includes a plurality of upper contact parts, each of the upper contact parts being disposed between the chamber communication holes, wherein the chamber includes a plurality of lower contact parts that protrude upwardly from a bottom surface of the chamber, and wherein the channel switch unit includes:

upper bumps that protrude upwardly from the radial protrusions and from the channel openings and that are configured to cause the switch body to rotate based on the upper bumps contacting the upper contact parts; and lower bumps configured to cause the switch body to rotate based on the lower bumps contacting the lower contact parts.

14. The dishwasher of claim 13, wherein a width of the upper bumps that protrude upwardly from the channel openings decreases along a rotating direction of the switch body.

15. The dishwasher of claim 13, wherein the radial protrusions include a settling portion arranged between the upper bumps, and wherein the upper bumps include:

a first contact portion configured to start to contact the upper contact parts based on the switch body moving upward; and a second contact portion configured to contact the upper contact parts based on the switch body ceasing rotation.

16. The dishwasher of claim 15, wherein the upper bumps include:

a first inclined surface, wherein a height of the first inclined surface with respect to a top surface of the settling portion increases in a direction toward the first contact portion along a rotating direction of the switch body; and a second inclined surface, wherein a height of the second inclined surface with respect to the top surface of the settling portion decreases in a direction from the first contact portion toward the second contact portion.

17. The dishwasher of claim 16, wherein a gradient of the second inclined surface is less than a gradient of the first inclined surface.

18. The dishwasher of claim 15, wherein the lower bumps include:

a third contact portion configured to start to contact the lower contact parts based on the switch body moving downward; and a fourth contact portion configured to contact the lower contact parts based on the switch body ceasing rotation.

19. The dishwasher of claim 18, wherein the lower bumps include:

a third inclined surface, wherein a height of the third inclined surface with respect to a bottom surface of the settling portion increases in a direction toward the third contact portion along a rotating direction of the switch body; and a fourth inclined surface, wherein a height of the fourth inclined surface with respect to the bottom surface of the settling portion decreases in a direction from the third contact portion toward the fourth contact portion.

20. The dishwasher of claim 1, wherein the plurality of channels include:

a first channel configured to supply washing water to a first spray hole among the plurality of spray holes and configured to rotate the arm body in a first direction, and a second channel configured to supply washing water to a second spray hole among the plurality of spray holes and configured to rotate the arm body in a second direction, wherein the arm body defines:

a first chamber communication hole that is configured to communicate with the first channel and the chamber, and a second chamber communication hole that is configured to communicate with the second channel and the chamber, and wherein the channel switch unit is configured to alternately open the first chamber communication hole and the second chamber communication hole.

* * * * *